US009279202B2

(12) United States Patent
Matsumura et al.

(10) Patent No.: US 9,279,202 B2
(45) Date of Patent: Mar. 8, 2016

(54) NEEDLE-PUNCHED NONWOVEN FABRIC

(71) Applicant: Toray Industries, Inc., Tokyo (JP)

(72) Inventors: Kazuya Matsumura, Otsu (JP); Hiroshi Kajiyama, Otsu (JP); Shusaku Narita, Otsu (JP); Seiji Yokoi, Toyota (JP); Shuntaro Ishii, Toyota (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 14/057,568

(22) Filed: Oct. 18, 2013

(65) Prior Publication Data

US 2014/0041171 A1 Feb. 13, 2014

Related U.S. Application Data

(62) Division of application No. 13/320,997, filed as application No. PCT/JP2010/058522 on May 20, 2010, now abandoned.

(30) Foreign Application Priority Data

May 25, 2009 (JP) ..... 2009-125712

(51) Int. Cl.

| | |
|---|---|
| ***D04H 1/46*** | (2012.01) |
| ***D04H 1/435*** | (2012.01) |
| ***D04H 1/482*** | (2012.01) |
| ***D01G 15/00*** | (2006.01) |

(52) U.S. Cl.

CPC ..... *D04H 1/46* (2013.01); *D01G 15/00* (2013.01); *D04H 1/435* (2013.01); *D04H 1/482* (2013.01); *Y10T 442/682* (2015.04)

(58) Field of Classification Search

CPC ..... D04H 1/04; D04H 1/435; D04H 1/46; D04H 1/482; D04H 1/50; D01G 15/00

USPC ..... 28/107, 112; 442/403, 407

See application file for complete search history.

(56) References Cited

U.S. PATENT DOCUMENTS

| | | | | |
|---|---|---|---|---|
| 7,268,190 | B2 | 9/2007 | Ohme et al. | |
| 7,799,424 | B2 * | 9/2010 | Mochiduki et al. | 428/357 |
| 2005/0008813 | A1 * | 1/2005 | Demott et al. | 428/97 |
| 2005/0039836 | A1 * | 2/2005 | Dugan et al. | 156/62.2 |
| 2005/0249931 | A1 | 11/2005 | Utsumi | |
| 2011/0057346 | A1 * | 3/2011 | Nunn | 264/103 |
| 2011/0250420 | A1 * | 10/2011 | Kalde | 428/220 |
| 2012/0116338 | A1 * | 5/2012 | Ferry et al. | 604/372 |

FOREIGN PATENT DOCUMENTS

| | | | |
|---|---|---|---|
| JP | 11-279920 | A | 10/1999 |
| JP | 2000-229369 | A | 8/2000 |
| JP | 2005-307359 | A | 11/2005 |
| JP | 2006-57197 | A | 3/2006 |
| JP | 2007-143945 | | 6/2007 |
| JP | 2007-230284 | | 9/2007 |
| JP | 2007-314913 | A | 12/2007 |
| JP | 2008-248419 | A | 10/2008 |
| WO | WO2006/104092 | | 10/2006 |

OTHER PUBLICATIONS

English language machine translation of JP 2006057197 (Matsunaga) Mar. 2, 2006, 11 pages.*

English language machine translation of JPH 11-279920 (Oct. 12, 1999) to Matsunaga, 15 pages.*

English language machine translation of JP 2008248419 (Oct. 16, 2008) to Yamaoto.*

International Search Report dated Jun. 22, 2010, application No. PCT/JP2010/058522.

* cited by examiner

*Primary Examiner* — Amy Vanatta

(74) *Attorney, Agent, or Firm* — RatnerPrestia

(57) ABSTRACT

The invention relates to a needle-punched nonwoven fabric wherein short fibers of polylactic acid containing an epoxy compound account for 20 to 40 mass % while short fibers of polyethylene terephthalate account for 80 to 60 mass %, the metsuke (weight per unit surface area) being 100 to 200 g/m$^2$, and the tensile strength per metsuke at 20° C. being 0.30 to 0.60 (N/cm)/(g/m$^2$) in the longitudinal direction and 0.48 to 0.90 (N/cm)/(g/m$^2$) in the lateral direction. The present invention provides needle-punched nonwoven fabrics that are low in environment load, high enough in durability to serve as interior finishing material for automobiles, and high in stretchability during molding.

5 Claims, No Drawings

NEEDLE-PUNCHED NONWOVEN FABRIC

CROSS-REFERENCE TO RELATED APPLICATIONS

This application is a divisional application of U.S. patent application Ser. No. 13/320,997, filed Nov. 17, 2011, which is the U.S. National Phase application of PCT International Application No. PCT/JP2010/058522, filed May 20, 2010, and claims priority to Japanese Patent Application No. JP2009-125712, filed May 25, 2009, the disclosures of each of these applications being incorporated herein by reference in their entireties for all purposes.

TECHNICAL FIELD

The present invention relates to a needle-punched nonwoven fabric produced from short fibers of polylactic acid.

BACKGROUND ART

In recent years, consciousness about the environment has been enhanced on a global basis, and there is growing concern about global warming caused by mass consumption of petroleum resources and depletion of petroleum resources resulting from the mass consumption.

Against this background, an imperative need recycling-oriented, environment-responsive materials that are composed of nonpetroleum components such as plant-derived ones (biomass) in particular and will be finally decomposed to water and carbon dioxide in natural environment after use. Among other recycling-oriented, environment-responsive materials, one of the most prospective is polylactic acid.

Under such circumstances, initial efforts in development of polylacted fiber have focused on agriculture materials and civil engineering materials with biodegradability, but now there are growing expectations for large-scale applications such as clothing, hygiene products, bedclothing, and other industrial materials.

Furthermore, polylactic acid fibers are also noteworthy as material for nonwoven fabrics because they general have a high strength and an elongation percentage in good balance as well as a low Young's modulus to serve to provide cloth material with soft texture.

In recent years, new nonwoven fabrics of polylactic acid fiber have been developed as interior finishing materials for automobiles. Other nonwoven fabrics have already been in use for interior finishing of automobiles, but nonwoven fabrics of polylactic acid fibers now offer promising prospects as automobile finishing materials because there is an increased need for replacement of conventional materials with environment-oriented ones in the automobile industry. To this end, there have been studies on nonwoven fabrics including polylactic acid fibers with the aim of providing interior finishing materials for automobiles, resulting in development of nonwoven fabrics composed of polylactic acid and other fibers as well as those made of polylactic acid fibers alone.

Patent document 1, for instance, proposes a needle-punched nonwoven fabric produced from polylactic acid fiber, which is a plant-derived fiber, and polytrimethylene terephthalate fiber.

Furthermore, Patent document 2 proposes a nonwoven fabric produced from short fibers of polylactic acid. The technique described in this Patent document 2 is designed to produce nonwoven fabrics from a polylactic acid with a low dry-heat shrinkability that has undergone heat shrinkage in advance in order to reduce shrinkage during the nonwoven fabric production process. This is because interior finishing materials for automobiles are generally heated at 120 to 180° C. during their molding, and the resulting shrinkage has been feared to cause problems such as warp and deformation.

PATENT DOCUMENTS

Patent document 1: JP 2007-314913 A
Patent document 2: JP 2005-307359 A

SUMMARY OF THE INVENTION

It has been discovered that the materials produced with the technique described in Patent document 1 are not sufficiently high in durability when used for interior finishing of vehicles, and the polylactic acid fibers can undergo fusion during molding. The technique described in Patent document 2 can effectively depress shrinkage, but the resulting materials are not sufficiently high in durability.

For molding of interior finishing materials for automobiles, it is important not only to depress the shrinkage during molding, but also maintain a high elongation degree. In this respect, both the technique described in Patent document 1 and the technique described in Patent document 2 do not provide materials that can stretch sufficiently during molding.

To solve the problem, the present invention aims to provide needle-punched nonwoven fabrics comprising nonpetroleum components that are high in both durability and stretchability during molding and suitable as interior finishing material for automobiles.

The needle-punched nonwoven fabrics according to an embodiment of the invention that can solve the above mentioned problem include short fibers of polylactic acid comprising an epoxy compound that account for 20 to 40 mass % while short fibers of polyethylene terephthalate account for 60 to 80 mass %, the metsuke (weight per unit surface area) being 100 to 200 g/m$^2$, and the tensile strength per metsuke at 20° C. being 0.30 to 0.60 (N/cm)/(g/m$^2$) in the longitudinal direction and 0.48 to 0.90 (N/cm)/(g/m$^2$) in the lateral direction.

The present invention can provide needle-punched nonwoven fabrics that are low in environment load, high enough in durability to serve as interior finishing material for automobiles, and high in stretchability during molding.

DETAILED DESCRIPTION OF THE INVENTION

[Polylactic Acid]

Two types of polylactic acid compounds have been known: those mainly comprising L-lactic acid components and those mainly comprising D-lactic acid components. The material to be used for the invention may comprise either type of polylactic acid. If the lactic acid component in the polylactic acid has an optical purity of 97% or more, it is preferable because it is possible to produce a resin with a high melting point and accordingly with a high heat resistance. The crystallinity of polylactic acid generally decreases with a decreasing optical purity, and therefore, moldings produced from a polylactic acid with a low optical purity tend to have a decreased heat resistance. Consequently, polylactic acids with an optical purity of 97% or more are commonly used preferably. If each polymer molecule has an optical purity of 97% or more, it is possible, for instance, to use a polylactic acid material prepared by melt-mixing a polymer mainly comprising an L-lactic acid and a polymer mainly comprising a D-lactic acid. In this case, polylactic acid molecular chains mainly comprising an L-lactic acid and polymer mainly molecular chains comprising a D-lactic acid can form stereocomplex crystals, and said crystals can have a still higher melting point than the homopolymers. If such a polylactic acid material prepared by melt-mixing a polymer mainly comprising an L-lactic acid and a polymer mainly comprising a D-lactic acid is used, the resulting nonwoven fabrics according to embodiments of the invention and the final molded products produced from them will have a very high heat resistance.

Furthermore, it is preferable that the polylactic acid has a weight average molecular weight of 80,000 or more from the viewpoint of heat resistance and moldability. If the weight average molecular weight is 80,000 or more, the resulting molded product will not only have improved mechanical characteristics and high durability, but also maintain flowability during melting and crystallization characteristics in a preferable range, and in addition, it will also be possible to easily produce the staple fiber (short fiber) to be used for the invention. From these reasons, the weight average molecular weight is preferably in the range of 80,000 to 400,000, more preferably 100,000 to 250,000.

The polylactic acid used for the invention may contain other modifying agents and additives as well as other polymers as long as its characteristics are maintained. These modifying agents, additives, and other polymers may be added during the polymerization step, may be added in the form of master pellets prepared in advance by kneading, or may be added directly to the polylactic acid pellets followed by mixing and melt molding. Furthermore, the polylactic acid used for the invention may be copolymerized with other monomers as long as its characteristics are maintained. The usable copolymerization components include dicarboxylic acid, diol, hydroxycarboxylic acid, and modifications thereof. There are no specific limitations on the content of these copolymerization components, it is preferable that the copolymerization components account for less than 40 mol % per polylactic acid because modification effect can be achieved without causing large changes in the characteristics of the aliphatic polyester that acts as basic component.

[Polylactic Acid Short Fiber]

The polylactic acid short fiber to be used to produce the needle-punched nonwoven fabric according to embodiments of the invention contains an epoxy compound as end capping agent for the polylactic acid. The use of short fibers of a polylactic acid that is end-capped with an epoxy compound serves to produce a needle-punched nonwoven fabric that is high enough in durability to act as interior finishing material for automobiles. In particular, it is preferable that tri- or more-functional epoxy compound is added so that the tri- or more-functional epoxy compound will react with at least part of the polylactic acid. It is more preferable that said tri- or more-functional epoxy compound reacts with at least part of the chain ends of the polylactic acid. Said tri- or more-functional epoxy compound is a compound that contains three or more epoxy groups in one molecule. The reason for the use of a compound that contains three or more epoxy groups in one molecule is that this allows part of the compound to react with the polylactic acid when melt-kneaded with said polylactic acid and subsequently allows the remaining epoxy groups to react further with the polylactic acid during the second melt molding step to increase the molecular weight and accordingly obtain a final molded product with a dramatically improved durability. Here, epoxy compounds are low in the rate of reaction with a polylactic acid as compared with other end-reactive substances such as carbodiimide compounds. Therefore, if an epoxy compound is used as said substance to be added to the polylactic acid, the molecular weight of the polylactic acid will not increase to an extremely high degree, and it will be difficult for the epoxy groups to entirely react with the polylactic acid, making it easy to produce a structure consisting of unreacted epoxy groups remaining in the short fibers of the polylactic acid.

Furthermore, it is preferable that said tri- or more-functional epoxy compound to be used for the invention is a compound that contains at least one glycidyl oxycarbonyl group or N-(glycidyl) amide group in one molecule.

For the polylactic acid used for the invention, it is preferable that the COOH end group concentration in the polylactic acid, which represents its reactivity with an epoxy compound, is in the range of 1 to 20 eq/t. The reason for the use of a polylactic acid with a COOH end group concentration of 20 eq/t or less is that such a polylactic acid can have an improved durability although polylactic acids are commonly easily suffer degradation due to hydrolysis during storage, transportation in a ship, etc. If the COOH end group concentration is less than 1 eq/t, on the other hand, production of short fibers tends to be difficult.

With respect to the content of the epoxy compound in the short fibers of the polylactic acid, it is preferable that the quantity of the residual epoxy groups in the short fibers of the polylactic acid is 0.1 to 0.5 eq/kg.

The quantity of the residual epoxy groups is determined according to the method for determination of the epoxy group content (equivalents) in epoxy resin specified in JIS K7236 (2001). Specifically, a specimen is put in a beaker, and 20 ml of chloroform is added to dissolve it, followed by adding 40 ml of acetic acid and 10 ml of an acetic acid solution of tetraethyl ammonium bromide and carrying out potentiometric titration with 0.1 mol/L perchloric acid (acetic acid solution). Subsequently, in order to correct the quantity of the 0.1 mol/L perchloric acid (acetic acid solution) consumed by the specimen, only chloroform and acetic acid are added to the specimen and the solution is titrated, followed by subtracting the result to obtain a calculation for correction.

If the quantity of the residual epoxy groups in polylactic acid short fibers is less than 0.1 eq/kg, the quantity the epoxy compound is not large enough for reaction with polylactic acid, possibly failing to achieve a high durability required for interior finishing of automobiles. If it is more than 0.5 eq/kg, the polylactic acid polymer and the epoxy-based end-capping agent work to increase the viscosity, possibly making it difficult to produce short fibers.

In view of the heat resistance and reaction efficiency which depends on the epoxy index, the preferable examples of said tri- or more-functional epoxy compounds include tetrakis-7, 8-dimethyl-1,7,8,14-tetradecane tetracarboxylate (oxiranylmethyl), diglycidyl 7-oxabicyclo-[4.1.0]-heptane-3,4-dicarboxylate, and trig lycidyl isocyanurate. Furthermore, the use of triglycidyl isocyanurate as monomer is particularly preferable because of its high reactivity and handleability. Triglycidyl isocyanurate is powder with a melting point of about 100° C. that is easy to handle, and in addition, when melt-mixed with the polylactic acid polymer used for the invention, the triglycidyl isocyanurate is melted to form a material having a structure in which a tri- or more-functional epoxy compound is finely dispersed in polylactic acid. Thus, the unevenness in melt viscosity and molecular weight of the resin can be reduced, making it possible to perform stable production of polylactic acid short fibers. In particular, because the compound itself has a high degree of crystallinity, furthermore, fumes due to scattering of the epoxy compound can be reduced during the production of moldings from the polylactic acid short fibers.

For the polylactic acid short fibers to be used for the invention, it is preferable that the monofilament fineness is controlled in the range of 0.01 to 25 dtex. It is preferably in the range of 1.5 to 20 dtex from the viewpoint of smooth passage through a carding or needle punching step. There are no specific limitations on the cross section shape of the polylactic acid short fibers, and the cross section may be in the form of, for instance, circular, trifoliate, cross-shaped, W-shaped, H-shaped, hollow circular, or hollow lattice-shaped. Of these, a circular cross section is preferable from the viewpoint of easy production.

It is preferable that the polylactic acid short fibers according to the invention have a strength of 0.8 cN/dtex or more. If the strength is 0.8 cN/dtex or more, thread breakage will take place less frequently during the carding or needle punching step, leading to stable production. The upper limit is not particularly specified, but in view of the common strength range of polylactic acid fibers, no problems will take place if it is 8 cN/dtex or less. From these considerations, it is preferable that the polylactic acid short fibers to be used for the invention have a strength in the range of 0.8 to 8 cN/dtex.

For the polylactic acid short fibers, furthermore, it is also preferable that the short fibers are shrunk by heat treatment so that the short fibers will not suffer a significant degree of dry-heat shrinkage when subjected to dry-heat treatment at 150° C. for 20 minutes. It is preferable that the degree of dry-heat shrinkage is in the range of 0.0 to 2.0% because it will be possible to reduce the dimensional changes that accompany the molding of a nonwoven fabric.

There are no specific limitations on the fiber length, and it may be in the range of 0.1 to 100 mm as in the case of conventional short fibers. From the viewpoint of smooth passage through a carding or needle punching step, it is preferably in the range of 20 to 80 mm, more preferably 30 to 70 mm.

It is preferable that the polylactic acid short fibers to be used for the invention are crimped. To crimp the polylactic acid short fibers, any conventional method may work, and examples include, for instance, the stuffing box method, forced-air heating gear method, and high-speed forced air injection method. In addition, it is also preferable that a lubricant is added as finishing agent as needed after the stretching step or a crimping step. The extent of crimping is preferably 6 to 25 crimps/25 mm in terms of the number of crimps or 10 to 40% in terms of the degree of crimping, more preferably 8 to 15 crimps/25 mm in terms of the number of crimps or 15 to 30% in terms of the degree of crimping.

[Short Fiber of Polyethylene Terephthalate]

Conventionally known polyethylene terephthalate short fibers may be used for the invention. There are no specific limitations on the monofilament fineness, but from the viewpoint of blending with polylactic acid short fibers, it is preferably 0.01 to 25 dtex. From the viewpoint of smooth passage through a carding or needle punching step, it is preferably 1.5 to 20 dtex.

There are no specific limitations on the cross section shape of the polyethylene terephthalate acid short fibers, and the cross section may be in the form of, for instance, circular, trifoliate, cross-shaped, W-shaped, hollow circular, or hollow lattice-shaped. Of these, a circular cross section is preferable from the viewpoint of easy production.

It is preferable that the polyethylene terephthalate short fibers to be used for the invention have a strength of 0.8 cN/dtex or more. If the strength is 0.8 cN/dtex or more, thread breakage will take place less frequently during the carding or needle punching step, leading to stable production. The upper limit is not particularly specified, but in view of the common strength range of polyethylene terephthalate fibers, no problems will take place if it is 8 cN/dtex or less. From these considerations, it is preferable that the polyethylene terephthalate short fibers to be used for the invention have a strength in the range of 0.8 to 8 cN/dtex.

There are no specific limitations on the fiber length, and it may be in the range of 0.1 to 100 mm as in the case of conventional short fibers. From the viewpoint of smooth passage through a carding or needle punching step, it is preferably in the range of 20 to 80 mm, more preferably 30 to 70 mm.

[Needle-Punched Nonwoven Fabric]

The needle-punched nonwoven fabric according to an embodiment of the invention consists of 20 to 40 mass % polylactic acid short fibers containing an epoxy compound and 60 to 80 mass % polyethylene terephthalate short fibers. If the needle-punched nonwoven fabric consists of the components in these percentage ranges, fusion of fibers will not take place significantly during the molding step, and it will be possible to provide a nonwoven fabric that can stretch significantly during the molding step.

The needle-punched nonwoven fabric according to embodiments of the invention contains polyethylene terephthalate short fibers that can be stretched significantly at high temperatures, and as a characteristic therefore, the nonwoven fabric can be stretched significantly at high temperatures. As a result of this, when it is used as material for interior finishing of vehicles that are produced by molding in a die, it is more stretchable and moldable than the conventional nonwoven fabrics of polyethylene terephthalate short fibers.

If the short fibers of a polylactic acid comprising an epoxy compound account for more than 40 mass % in the nonwoven fabric, fusion of fibers will take place more easily during the molding step. If the short fibers of a polylactic acid comprising an epoxy compound account for less than 20 mass %, on the other hand, not only the stretchability during the molding step will deteriorate but also the biomass ratio will also decrease.

If the short fibers of polyethylene terephthalate account for more than 80 mass % in the nonwoven fabric, the tensile strength will be high in a high temperature atmosphere and the stretchability will be low during the molding step, possibly leading to breakage of the nonwoven fabric during the molding step or resulting in a sheer fabric with a decreased thickness. If the short fibers of polyethylene terephthalate account for less than 60 mass %, the product will be low in tensile strength in a high temperature atmosphere and will not easily meet the functional requirements for interior finishing material for automobiles.

The needle-punched nonwoven fabric according to embodiments of the invention has a metsuke of 100 to 200 $g/m^2$. If the metsuke is in this range, the nonwoven fabric will be highly stretchable during the molding step and will be rarely sheer in the deep-draw portions after the molding step.

For the needle-punched nonwoven fabric according to the invention, the tensile strength per metsuke at a temperature of 20° C. is in the range of 0.30 to 0.60 $(N/cm)/(g/m^2)$ in the longitudinal direction and 0.48 to 0.90 $(N/cm)/(g/m^2)$ in the lateral direction. The tensile strength per metsuke as referred to here is the tensile strength per centimeter of the width divided by the metsuke value, and this index is used herein in order to evaluate the tensile strength of nonwoven fabrics without being influenced by the metsuke value. The longitudinal direction is the length direction of the needle-punched nonwoven fabric being produced, and the lateral direction is perpendicular to the longitudinal direction and parallel to the surface of the nonwoven fabric. If it is less than 0.30 $(N/cm)/(g/m^2)$ in the longitudinal direction or less than 0.48 $(N/cm)/(g/m^2)$ in the lateral direction, the nonwoven fabric will not have a sufficient strength required for the molding step. If it is more than 0.60 (N/cm)/(g/m$^2$) in the longitudinal direction or more than 0.90 (N/cm)/(g/m$^2$) in the lateral direction, on the other hand, the molded product resulting from the molding step will suffer significant dimensional changes, making it difficult to combine several molded products, and the dimensional changes will be also significant at high temperatures.

For the needle-punched nonwoven fabric according to the invention, it is preferable that the tensile strength per metsuke at 130° C. is in the range of 0.30 to 0.40 (N/cm)/(g/m$^2$) in the longitudinal direction and 0.36 to 0.50 (N/cm)/(g/m$^2$) in the lateral direction. If it is more than 0.30 (N/cm)/(g/m$^2$) in the longitudinal direction and more than 0.36 (N/cm)/(g/m$^2$) in the lateral direction, the nonwoven fabric will maintain a sufficient strength when heated, and work preferably as interior finishing material for automobiles. If it is less than 0.40 (N/cm)/(g/m$^2$) in the longitudinal direction and less than 0.50 (N/cm)/(g/m$^2$) in the lateral direction, the nonwoven fabric can be stretched sufficiently in a high temperature atmosphere, and can work preferably as interior finishing material for automobiles.

The tensile strength of the needle-punched nonwoven fabric according to the invention may be adjusted by changing the fineness ratio and tensile strength of the constituent fibers and the entanglement state (number of the needles used for needle-punching, and number of punching motions) of the fibers.

For instance, it is preferable that the constituent fibers have a fineness of 1.5 to 10 dtex, and with respect to the component ratio in this case, it is preferable that the fibers of 1.5 to 5 dtex account for 10 to 60% and those of 5 to 10 dtex account for 40 to 90%. The fineness of the constituent fibers is more preferably 2.2 to 8 dtex.

With respect to the tensile strength of the constituent fibers, the strength of polylactic acid fibers should be 1.0 to 3.0 cN/dtex while the strength of polyethylene terephthalate should be 2.0 to 5.0 cN/dtex, and with respect to the entanglement state during the production step, the number of needles used for needle punching should be 200 to 600 needles/cm$^2$. When the fibers of 1.5 to 5 dtex account for 10 to 30% in terms of fiber ratio, it is preferable that the number is 200 to 400 needles/cm$^2$, more preferably 250 to 400 needles/cm$^2$. When the fibers of 1.5 to 5 dtex account for 30 to 60% in terms of fiber ratio, it is preferable that the number is 300 to 600 needles/cm$^2$, more preferably 350 to 600 needles/cm$^2$.

It is preferable that the needle-punched nonwoven fabric according to the invention does not carry resin such as polyurethane resin, acrylic resin, and polyester resin adhered on its surface. It is because nonwoven fabrics used for interior finishing of automobiles commonly undergo resin finishing with resin, but this resin finishing can impair the high stretchability during the molding step which is one of the most striking features of the needle-punched nonwoven fabric according to the invention. By eliminating such resin finishing, it is possible to provide a better needle-punched nonwoven fabric that is high enough in durability for interior finishing of automobiles and high in stretchability during the molding step. Said resin finishing is defined as treatment designed to spread resin over either side or both sides of the nonwoven fabric or add resin to at least some internal portions of the nonwoven fabric by carrying out a method such as nip-dip method, frothing, spraying, coating, and T-die extrusion.

There are no specific limitations on the method used to produce the needle-punched nonwoven fabric according to the invention, and any conventionally known needle-punched nonwoven fabric production methods may be used. Specifically, it can be produced by opening short fibers, mixing them, spinning them with a carding machine to provide fleece, and punching the fleece with a needle punching machine.

High in durability and stretchability during the molding step, the needle-punched nonwoven fabric according to the invention is generally suitable as three-dimensional interior finishing materials for automobiles such as ceiling material, floor carpet, optional mat, surface sheet of luggage room, and surface sheet of trim. In addition, it is also suitable as interior finish material for carpets for exhibition sites or carpets for offices as well as for interfacing, protective cushioning medium, and filters for civil engineering.

EXAMPLES (Polylactic Acid Short Fiber SF1)

Polylactic acid chips with a particle size of 35 mg/particle and a COOH end group content of 25.2 eq/t comprising L-polylactic acid with a weight average molecular weight (Mw) of 140,000, a polydispersity index (Mw/Mn) of 1.7, and an optical purity of 97% or more was fed to a hopper of a spinning machine. A pigment (carbon black) and a tri- or more-functional epoxy compound (triglycidyl isocyanurate) were fed to another hopper. Using an extruder type spinning machine, they were melted at 220° C., spun at discharge rate of 510 g/min from an orifice with 300 holes, and taken up at a spinning speed of 1,000 m/min. Several threads produced by the same procedure were combined and received in a can. Several such stretched threads were combined to provide a tow of 27.7 ktex, which was then stretched 3.5 times in a water bath at 80° C. and crimped in a stuffing box. Subsequently, the product was heat-treated at 130° C. for relaxation, treated with a lubricant, and cut. The resulting polylactic acid short fiber had a monofilament fineness of 6.7 dtex, fiber length of 51 mm, strength of 2.1 cN/dtex, elongation percentage of 75.0%, crimp density of 9.8 crimps/25 mm, crimping degree of 13.9%, dry-heat shrinkage degree of 1.2%, carboxyl end group content of 6.6 eq/t, and quantity of residual epoxy groups of 0.166 eq/kg. This is referred as polylactic acid short fiber SF1.

(Polylactic Acid Short Fiber SF2)

Polylactic acid chips with a particle size of 35 mg/particle and a COOH end group content of 25.2 eq/t comprising L-polylactic acid with a weight average molecular weight (Mw) of 140,000, a polydispersity index (Mw/Mn) of 1.7, and an optical purity of 97% or more was fed to a hopper of a spinning machine. A pigment (carbon black) was fed to another hopper. Using an extruder type spinning machine, they were melted at 220° C., spun at discharge rate of 510 g/min from an orifice with 300 holes, and taken up at a spinning speed of 1,000 m/min. Several threads produced by the same procedure were combined and received in a can. Several such stretched threads were combined to provide a tow of 27.7 ktex, which was then stretched 3.5 times in a water bath at 80° C. and crimped in a stuffing box. Subsequently, the product was heat-treated at 130° C. for relaxation, treated with a lubricant, and cut. The resulting polylactic acid short fiber had a monofilament fineness of 6.6 dtex, fiber length of 51 mm, strength of 2.0 cN/dtex, elongation percentage of 72.8%, crimp density of 10.5 crimps/25 mm, crimping degree of 12.8%, dry-heat shrinkage degree of 1.0%, carboxyl end group content of 26.7 eq/t, and quantity of residual epoxy groups of 0.005 eq/kg or less. This is referred as polylactic acid short fiber SF2.

(Polyethylene Terephthalate Short Fiber SF3)

A polyethylene terephthalate short fiber with a monofilament fineness of 3.6 dtex, fiber length of 51 mm, strength of 3.0 cN/dtex, elongation percentage of 38.3%, crimp density of 12.0 crimps/25 mm, crimping degree of 21.5%, and dry-heat shrinkage degree of 1.5% was prepared. This is referred as polyethylene terephthalate short fiber SF3.

(Polyethylene Terephthalate Short Fiber SF4)

A polyethylene terephthalate short fiber with a monofilament fineness of 6.7 dtex, fiber length of 51 mm, strength of 3.3 cN/dtex, elongation percentage of 68.0%, crimp density of 13.2 crimps/25 mm, crimping degree of 20.2%, and dry-heat shrinkage degree of 1.5% was prepared. This is referred as polyethylene terephthalate short fiber SF4.

(Polytrimethylene Terephthalate Short Fiber SF5)

A polytrimethylene terephthalate short fiber with a monofilament fineness of 6.6 dtex, fiber length of 51 mm, strength of 2.0 cN/dtex, elongation percentage of 93.5%, crimp density of 8.6 crimps/25 mm, crimping degree of 5.4%, and dry-heat shrinkage degree of 0.7% was prepared. This is referred as polytrimethylene terephthalate short fiber SFS.

[Measuring Method]

(1) Weight Average Molecular Weight of Polylactic Acid

A chloroform solution of a sample was mixed with tetrahydrofuran to provide a specimen for measurement. This was subjected to measurement by gel permeation chromatography (GPC) to determine the polystyrene-based weight average molecular weight.

(2) Monofilament Fineness

The monofilament fineness was measured according to the 8.5.1 A method specified in JIS L 1015 (1999). A small amount of a sample was taken and fibers were paralleled with a metallic comb and put on flock paper spread on a cutting table. With sample held straight by stretching it with a moderate force, a gauge board is applied and the sample was cut with a razor blade to a length of 30 mm. Fibers were counted and a set of 300 fibers was prepared, followed by measuring its mass and determining its apparent fineness. A conditioned fineness (dtex) was calculated from this apparent fineness and the equilibrium moisture regain determined elsewhere by the equation given below. Five measurements were made by carrying out the same procedure, and the average of the conditioned fineness values was taken as the monofilament fineness (dtex).

$$F0=D'\times\{(100+R0)/(100+Re)\}$$

F0: conditioned fineness (dtex)

D': apparent fineness (dtex)

R0: moisture content of polylactic acid (0.5%)

Re: equilibrium moisture regain (3) Fiber Length

The fiber length was measured according to the 8.4.1 A method specified in JIS L 1015 (1999). Fibers of the sample were paralleled with a metallic comb and a staple diagram with a width of about 25 cm was prepared using a paired sorter. For this preparation, the grip-and-pull cycle was repeated about 70 times to arrange all fibers aligned parallel on a velvet sheet. A scaled celluloid plate was put on this, and a diagram was prepared on a piece of graph paper. A staple diagram thus prepared was divided equally into 50 portions according to fiber length, and the fiber length was measured at each boundary between these portions as well at both edge of the diagram, followed by adding the average of the fiber length at the edges to the 49 boundary fiber length measurement dividing the sum by 50 to calculate the average fiber length (mm).

(4) Tensile Strength and Elongation Degree

The tensile strength and elongation degree were measured according to the 8.7.1 method specified in JIS L 1015 (1999). With a space distance of 20 mm, fibers were extended loosely, each along a dividing line and both ends fixed with an adhesive, and each division was used as a specimen. A specimen was attached to clamps of a tensile testing machine and the paper was cut near the upper clamp, followed by carrying out tensile test with a clamp interval of 20 mm and tension speed of 20 mm/min and measuring the load (N) and elongation (mm) at the time of rupture of the specimen. The tensile strength (cN/dtex) and elongation degree (%) were calculated by the following equation.

$$Tb=SD/F0$$

Tb: tensile strength (cN/dtex)

SD: load (cN) at rupture

F0: conditioned fineness of specimen (dtex)

$$S=\{(E2-E1)/(L+E1)\}\times100$$

S: elongation degree (%)

E1: relaxation (mm)

E2: elongation at breakage (mm) or elongation at maximum load (mm)

L: clamp distance (mm)

(5) Crimp Density

The crimp density was measured according to the 8.12.1 method specified in JIS L 1015 (1999). Dividing lines were prepared by the same procedure as in item (4) (with a space distance of 25 mm). Fiber specimens were taken from a few portions where crimps were not damaged, and each specimen was extended with a slack degree of 25±5% relative to the space distance and both ends were fixed with an adhesive. Each specimen was attached to the clamps of a crimp testing machine and an initial load (0.18 mN×reading in tex) was applied to the specimen, immediately followed by reading the distance between the clamps (space distance) (mm) and counting the number of crimps to calculate the number of crimps existing over a length of 25 mm. A total of 20 specimens were subjected to the same test, and the average was taken as the crimp density.

(6) Crimp Degree

The crimp degree was measured according to the 8.12.2 method specified in JIS L 1015 (1999). The length of the specimen after applying an initial load (0.18 mN×reading in tex) and the length after applying an additional load (4.41 mN×reading in tex) were measured and the crimp degree was calculated by the following equation.

$$Cp=\{(b-a)/b\}\times100$$

Cp: crimp degree (%)

a: length under initial load (mm)

b: length under a load of 4.41 mN×reading in tex (mm)

(7) Dry-Heat Shrinkage Degree

The dry-heat shrinkage degree was measured according to the 8.15 method specified in JIS L 1015 (1999). Dividing lines were prepared by the same procedure as in item (4) (with a space distance of 25 mm) and the length under the initial load (mm) was read. The specimen was taken out of the equipment, hung in a drying machine at 150° C., and left there for 30 minutes. Then, the specimen was taken out of the drying machine and left to cool to room temperature. Subsequently, the specimen was attached to the equipment again, and the initial load was applied, followed by reading the distance between the clamps and calculating the dry-heat shrinkage degree by the following equation.

$$Sd=\{(L-L')/L\}\times100$$

Sd: dry-heat shrinkage degree (%)

L: distance between the clamps under the initial load before treatment (mm)

L': distance between the clamps under the initial load after treatment (mm)

(8) Metsuke of Nonwoven Fabric

The metsuke was measured according to the 6.2 method specified in JIS L 1913 (1998). Three test pieces of 25 cm×25 cm were taken, and the mass (g) of each of them was measured under standard conditions (temperature 20±2° C. and relative humidity 65±4%), followed by calculating the mass per square meter (g/m$^2$) and its average.

$$Sm=W/A$$

Sm: metsuke (g/m$^2$)

W: mass (g) of test piece under standard conditions

A: area of test piece (m$^2$)

(9) Quantity of Residual Epoxy Groups

The quantity of residual epoxy groups is determined according to the method for determination of the epoxy group content (equivalents) in epoxy resin specified in JIS K7236 (2001). A specimen was put in a beaker, and 20 ml of chloroform was added to dissolve it, followed by adding 40 ml of acetic acid and 10 ml of an acetic acid solution of tetraethyl ammonium bromide and carrying out potentiometric titration with 0.1 mol/L perchloric acid (acetic acid solution). Subsequently, in order to correct the quantity of the 0.1 mol/L perchloric acid (acetic acid solution) consumed by the specimen, only chloroform and acetic acid were added to the specimen and the solution was titrated, followed by subtracting the result to obtain a calculation for correction.

(10) Carboxyl End Group Content

A precisely weighed portion of a specimen was dissolved in o-cresol (water content 5%) and an appropriate volume of dichloromethane was added to this solution, followed by titration with 0.02N KOH methanol solution to determine this content. Since oligomers such as lactides, i.e. cyclic dimers of lactic acid are hydrolyzed to form carboxyl end groups, the carboxyl end group content determined above represents all carboxyl end groups including carboxyl end groups in polymers, monomer-derived carboxyl end groups, and oligomer-derived carboxyl end groups.

(11) Tensile strength per metsuke at 20° C.

The tensile strength per metsuke was measured according to the 6.3.1 method specified in JIS L 1913 (1998). Using an Instron type tensile tester under the conditions of an ambient temperature of 20±2° C., specimen width of 30 mm, clamp distance of 150 mm, and tension speed of 200 mm/min, an increasing load was applied to the test piece until it breaks, and the strength of the test piece at the maximum load was measured to the nearest 0.1N. This value was divided by the test width of 3 cm to calculate the tensile strength g0 per centimeter. The value of g0 was divided by the metsuke Sm of the nonwoven fabric determined in item (8) to calculate the tensile strength per metsuke. By repeating the same procedure, measurements and calculations were obtained for a total of five test pieces, and their average was taken as the tensile strength per metsuke of this sample.

$$\text{Tensile strength per mass}((\text{N/cm})/(\text{g/m}^2))=g0/Sm$$

g0: strength at maximum load for test piece with a width of 1 cm (N/cm)

Sm: metsuke of nonwoven fabric (g/m$^2$)

(12) Tensile Strength Per Metsuke at 130° C.

A test piece was left to stand for 1 minute in a test furnace with an air temperature of 130±2° C., followed by making measurements at an ambient temperature of 130±2° C. by the same procedure as for the tensile strength per metsuke described in item (9). For the metsuke of the nonwoven fabric, metsuke measurements made under the standard conditions described in item (8) were used.

(13) Plant-Derived Content

The plant-derived content in a nonwoven fabric was evaluated based on the content of polylactic acid fibers or polytrimethylene terephthalate fibers. For the calculation, the content was assumed to be the component percentage multiplied by 100% in the case of polylactic acid and the component percentage multiplied by 37% (percentage of the plant-derived component contained in the polymer) in the case of polytrimethylene terephthalate. Specimens with a plant-derived content of 20% or more, those of 20% or less, and those with no such components were ranked A, B, and C, respectively.

(14) Moldability

Specimens with a tensile strength per metsuke at 130° C. in the range of 0.30 to 0.40 (N/cm)/(g/m$^2$) in the longitudinal direction and 0.36 to 0.50 (N/cm)/(g/m$^2$) in the lateral direction were ranked A, while those with an outlying value in either the longitudinal or the lateral direction or in both the longitudinal and the lateral direction were ranked B or C, respectively.

(15) Durability

A test piece with a size of 25 cm×25 cm was left to stand in an atmosphere of 80° C. and 30% Rh for 500 hours and observed for changes in the appearance of the nonwoven fabric to see if there existed significant changes in appearance resulting from degradation of polylactic acid short fibers. The criteria for their existence were as follows.

A: Powder resulting from degradation of polylactic acid short fibers was not found on the surface of the needle-punched nonwoven fabric.

B: Powder resulting from degradation of polylactic acid short fibers was found on the surface of the needle-punched nonwoven fabric.

(16) Melting of Molded Polylactic Acid Fiber

The surface of a molded product was observed and then evaluated according to the following criteria. With respect to the fabrication conditions, polypropylene sheet with a metsuke of 1 kg/m$^2$ and thickness of 1.2 mm was heated from both sides for 30 seconds using far-infrared heaters with a surface temperature set to 400° C., subsequently a surface sheet is stuck on the polypropylene sheet, and the polypropylene sheet with the surface sheet is held in an cold press for 20 seconds to prepare a molded product.

A: Hardened portions resulting from fusion of polylactic acid fibers were not found on the surface sheet of the molded product.

B: Hardened portions resulting from fusion of polylactic acid fibers were found on the surface sheet of the molded product.

Examples 1 to 3 and Comparative Example 1

[Blending]

Polylactic acid short fiber SF1, polyethylene terephthalate short fiber SF3, and polyethylene terephthalate short fiber SF4 were weighed out with a measuring apparatus according to the ratios shown in Tables 1 and 2 and fed to a blowing and scutching machine.

[Carding and Needle Punching]

The blend of short fibers was fed to a metal carding machine and spun at a spinning rate of 20 g/m$^2$ into a piece of fleece comprising entangled short fibers, followed by stacking nine such pieces with a crosslapper.

The stack of fleece was punched 10 times alternately from both sides with a needle punching machine under the conditions of a needle size of #38, punching depth of 15 mm, and first-run punching density of 42 needles/cm$^2$ to provide a needle-punched nonwoven fabric with a total punching density of 420 needles/cm$^2$. The physical properties of the resulting needle-punched nonwoven fabric are given in Table 1.

All needle-punched nonwoven fabric samples prepared in Examples 1 to 3 were ranked A when evaluated in terms of the plant-derived content, moldability, durability, and fusion of molded polylactic acid fibers, demonstrating good characteristics for interior finishing of automobiles.

The needle-punched nonwoven fabric sample prepared in Comparative example 1 was ranked A in the evaluation for plant-derived content and durability. However, polyethylene terephthalate short fibers accounted for less than 60 mass % and the sample was low in tensile strength at high temperatures and ranked C in moldability evaluation. Polylactic acid short fibers accounted for more than 40 mass % and the sample was ranked B in the evaluation for melting of molded polylactic acid fibers. Thus, the sample was not suitable as interior finishing material for automobiles.

Examples 4 and 5

[Blending]

Polylactic acid short fiber SF1, polyethylene terephthalate short fiber SF3, and polyethylene terephthalate short fiber SF4 were weighed out with a measuring apparatus according to the ratios shown in Table 1 and fed to a blowing and scutching machine.

[Carding and Needle Punching]

The blend of short fibers was fed to a metal carding machine and spun at a spinning rate of 20 g/m$^2$ into a piece of fleece comprising entangled short fibers while adjusting the metsuke to the values shown in table 1.

The stack of fleece was punched 10 times alternately from both sides with a needle punching machine under the conditions of a needle size of #38, punching depth of 15 mm, and first-run punching density of 42 needles/cm$^2$ to provide a needle-punched nonwoven fabric with a total punching density of 420 needles/cm$^2$. The physical properties of the resulting needle-punched nonwoven fabric are given in Table 1.

All needle-punched nonwoven fabric samples prepared in Examples 4 and 5 were ranked A when evaluated in terms of the plant-derived content, moldability, durability, and fusion of molded polylactic acid fibers, demonstrating good characteristics for interior finishing of automobiles.

Example 6

Polylactic acid short fiber SF1, polyethylene terephthalate short fiber SF3, and polyethylene terephthalate short fiber SF4 were weighed out with a measuring apparatus according to the ratios shown in Table 1 and fed to a blowing and scutching machine.

[Carding and Needle Punching]

The blend of short fibers was fed to a metal carding machine and spun at a spinning rate of 20 g/m$^2$ into a piece of fleece comprising entangled short fibers while adjusting the metsuke to the values shown in table 1.

The stack of fleece was punched 8 times alternately from both sides with a needle punching machine under the conditions of a needle size of #38, punching depth of 15 mm, and first-run punching density of 42 needles/cm$^2$ to provide a needle-punched nonwoven fabric with a total punching density of 336 needles/cm$^2$. The physical properties of the resulting needle-punched nonwoven fabric are given in Table 1.

The resulting needle-punched nonwoven fabric sample was ranked A in the evaluation for plant-derived content, durability, and fusion of molded polylactic acid fibers. Being slightly insufficient in the strength at high temperatures, the sample was ranked B in the moldability evaluation, but usable as interior finishing materials for automobiles.

Comparative Example 2

[Blending]

Polyethylene terephthalate short fiber SF3 and polyethylene terephthalate short fiber SF4 were weighed out with a measuring apparatus according to the ratios shown in Table 2 and fed to a blowing and scutching machine.

For the subsequent steps, the same procedure as in Example 1 was carried out to produce needle-punched nonwoven fabrics.

The resulting needle-punched nonwoven fabric sample was ranked A in the evaluation for durability and melting of the surface layer of molded PLA. However, the sample was ranked C in the plant-derived content evaluation since it did not contain polylactic acid short fibers, and it is low in stretchabililty during the molding step and ranked C in the moldability evaluation since polyethylene terephthalate short fibers accounted for more than 80 mass %, demonstrating that it was not suitable as interior finishing material for automobiles.

Comparative Example 3

Polylactic acid short fiber SF2, polyethylene terephthalate short fiber SF3 and polytrimethylene terephthalate short fiber SF5 were weighed out with a measuring apparatus according to the ratios shown in Table 2 and fed to a blowing and scutching machine. For the subsequent steps, the same procedure as in Example 1 was carried out to produce needle-punched nonwoven fabrics.

The resulting needle-punched nonwoven fabric sample was ranked A in the evaluation for plant-derived content and fusion of molded polylactic acid fibers. However, polyethylene terephthalate short fibers accounted for less than 60 mass % and the sample was low in tensile strength at high temperatures and ranked C in the moldability evaluation. The polylactic acid short fibers did not contain epoxy compounds and therefore the sample was ranked B in durability. Thus, the sample was not suitable as interior finishing material for automobiles.

Comparative Example 4

Polylactic acid short fiber SF2 was weighed out with a measuring apparatus according to the ratio shown in Table 2 and fed to a blowing and scutching machine. For the subsequent steps, the same procedure as in Example 1 was carried out to produce needle-punched nonwoven fabrics.

The resulting needle-punched nonwoven fabric sample was ranked A in the evaluation for plant-derived content. However, since polyethylene terephthalate short fibers were not contained, the sample was low in tensile strength at high temperatures and ranked C in the moldability evaluation. The polylactic acid short fibers did not contain epoxy compounds, leading the sample to be ranked B in durability, and polylactic acid short fibers accounted for more than 40 mass %, leading the sample to be ranked B in the evaluation for fusion of molded polylactic acid fibers. Thus, the sample was not suitable as interior finishing material for automobiles.

TABLE 1

| Test item | | Unit | Example 1 | Example 2 | Example 3 | Example 4 | Example 5 | Example 6 |
|---|---|---|---|---|---|---|---|---|
| Polylactic acid | Type | — | SF1 | SF1 | SF1 | SF1 | SF1 | SF1 |
| | Fineness | dtex | 6.7 | 6.7 | 6.7 | 6.7 | 6.7 | 6.7 |
| | Blending ratio | mass % | 20 | 30 | 40 | 30 | 30 | 30 |
| Polyethylene terephthalate | Type | — | SF3 | SF3 | SF3 | SF3 | SF3 | SF3 |
| Sort fiber | Fineness | dtex | 3.6 | 3.6 | 3.6 | 3.6 | 3.6 | 3.6 |
| | Blending ratio | mass % | 50 | 50 | 50 | 50 | 50 | 50 |
| Polyethylene terephthalate | Type | — | SF4 | SF4 | SF4 | SF4 | SF4 | SF4 |
| Sort fiber | Fineness | dtex | 6.7 | 6.7 | 6.7 | 6.7 | 6.7 | 6.7 |
| | Blending ratio | mass % | 30 | 20 | 10 | 20 | 20 | 20 |
| Polytrimethylen terephthalate | Type | — | — | — | — | — | — | — |
| Sort fiber | Fineness | dtex | — | — | — | — | — | — |
| | Blending ratio | mass % | — | — | — | — | — | — |
| Metsuke of nonwoven fabric | | $g/m^2$ | 182 | 185 | 178 | 198 | 111 | 185 |
| Number of needles | | $Needles/cm^2$ | 420 | 420 | 420 | 420 | 420 | 336 |
| Tensile strength per metsuke | Longitudinal direction | $(N/cm)/(g/m^2)$ | 0.488 | 0.385 | 0.366 | 0.429 | 0.311 | 0.352 |
| at 20° C. | Lateral direction | | 0.845 | 0.646 | 0.562 | 0.656 | 0.502 | 0.641 |
| Tensile strength per metsuke | Longitudinal direction | $(N/cm)/(g/m^2)$ | 0.378 | 0.358 | 0.344 | 0.379 | 0.308 | 0.320 |
| at 130° C. | Lateral direction | | 0.400 | 0.394 | 0.399 | 0.492 | 0.369 | 0.355 |
| Plant-derived content (*1) | | % | 20 (A) | 30 (A) | 40 (A) | 30 (A) | 30 (A) | 30 (A) |
| Moldability | | — | A | A | A | A | A | B |
| Durability | | — | A | A | A | A | A | A |
| Melting of molded polylactic acid fiber | | — | A | A | A | A | A | A |

*1: Evaluation results in parentheses

TABLE 2

| Test item | | Unit | Comparative example 1 | Comparative example 2 | Comparative example 3 | Comparative example 4 |
|---|---|---|---|---|---|---|
| Polylactic acid | Type | — | SF1 | — | SF2 | SF2 |
| | Fineness | dtex | 6.7 | — | 6.6 | 6.6 |
| | Blending ratio | mass % | 50 | — | 30 | 100 |
| Polyethylene terephthalate | Type | — | SF3 | SF3 | SF3 | — |
| Sort fiber | Fineness | dtex | 3.6 | 3.6 | 3.6 | — |
| | Blending ratio | mass % | 50 | 50 | 40 | — |
| Polyethylene terephthalate | Type | — | — | SF4 | — | — |
| Sort fiber | Fineness | dtex | — | 6.7 | — | — |
| | Blending ratio | mass % | — | 50 | — | — |
| Polytrimethylen terephthalate | Type | — | — | — | SF5 | — |
| Sort fiber | Fineness | dtex | — | — | 6.6 | — |
| | Blending ratio | mass % | — | — | 30 | — |
| Metsuke of nonwoven fabric | | $g/m^2$ | 183 | 175 | 175 | 179 |
| Number of needles | | $Needles/cm^2$ | 420 | 420 | 420 | 420 |
| Tensile strength per metsuke | Longitudinal direction | $(N/cm)/(g/m^2)$ | 0.286 | 0.514 | 0.322 | 0.244 |
| at 20° C. | Lateral direction | | 0.453 | 0.495 | 0.504 | 0.241 |
| Tensile strength per metsuke | Longitudinal direction | $(N/cm)/(g/m^2)$ | 0.246 | 0.406 | 0.288 | 0.181 |
| at 130° C. | Lateral direction | | 0.343 | 0.503 | 0.359 | 0.276 |
| Plant-derived content (*1) | | % | 50 (A) | 0 (C) | 41 (A) | 100 (A) |
| Moldability | | — | C | C | C | C |
| Durability | | — | A | A | B | B |
| Melting of molded polylactic acid fiber | | — | B | A | A | B |

*1: Evaluation results in parentheses

The invention claimed is:

1. A method of producing a needle punched nonwoven fabric comprising:

shrinking a first group of short fibers by heat treatment, the short fibers comprising polylactic acid end-capped with an epoxy compound;

blending the first group of short fibers with a second group of short fibers comprising polyethylene terephthalate to form blended fibers;

carding the blended fibers to form a plurality of fleece sheets;

stacking the fleece sheets; and needle-punching the plurality of fleece sheets to form a nonwoven fabric.

2. The method of claim 1, wherein the nonwoven fabric comprises 20 to 40 mass % of the first group of short fibers and 60 to 80 mass % of the second group of short fibers, and the nonwoven fabric has a weight per unit surface area of 100 to 200 $g/m^2$ and a tensile strength per weight per unit surface area at 20° C. of 0.30 to 0.60 $(N/cm)/(g/m^2)$ in the longitudinal direction and 0.48 to 0.90 $(N/cm)/(g/m^2)$ in the lateral direction.

3. The method of claim 2, wherein the nonwoven fabric has a tensile strength per weight per unit surface area at 130° C. of 0.30 to 0.40 $(N/cm)/(g/m^2)$ in the longitudinal direction and 0.36 to 0.50 $(N/cm)/(g/m^2)$ in the lateral direction.

4. The method of claim 1, wherein the epoxy compound prior to end-capping the polylactic acid includes at least three epoxy groups.

5. The method of claim 1, wherein the epoxy compound contains at least one glycidyl oxycarbonyl group or N-glycidyl amide group.

* * * * *